US006108949A

United States Patent [19]

Singh et al.

[11] Patent Number: 6,108,949

[45] Date of Patent: Aug. 29, 2000

[54] METHOD AND APPARATUS FOR DETERMINING AN EXCAVATION STRATEGY

[75] Inventors: Sanjiv Singh, Pittsburgh; Howard Cannon, Gibsonia, both of Pa.

[73] Assignee: Carnegie Mellon University, Pittsburgh, Pa.

[21] Appl. No.: 09/172,307

[22] Filed: Oct. 14, 1998

Related U.S. Application Data

[60] Provisional application No. 60/068,247, Dec. 19, 1997.

[51] Int. Cl.[7] ..... E02F 3/04

[52] U.S. Cl. ..... 37/414; 37/195; 701/50

[58] Field of Search ..... 701/50; 37/348, 37/195, 414; 172/2, 4.5

[56] References Cited

U.S. PATENT DOCUMENTS

| | | | |
|---|---|---|---|
| 5,446,980 | 9/1995 | Rocke | 37/348 |
| 5,461,803 | 10/1995 | Rocke | 37/443 |
| 5,528,843 | 6/1996 | Rocke | 37/443 |
| 5,603,059 | 2/1997 | Churchill et al. | 395/856 |

OTHER PUBLICATIONS

A. Hemami, Modelling, analysis and preliminary studies for automatic scooping/loading in a mechanical loader, International Journal of Surface Mining and Reclamation, pp. 151–159, 1992.

H. Takahashi, H. Kamata, T. Masuyama, & S. Sarata, Concept and Model Experiments on Automatic Shoveling of Rocks from the Rock Piles, Proceedings of 16th International Conference on Computers & Industrial Engineering, pp. 48–51, Mar. 7–9, 1994.

H. Takahashi, H. Kamata, T. Masuyama, & S. Sarata, Autonomous Shoveling of Rocks using Image Vision System on LHD, Proceedings of 3rd Mine Mechanization & Automation, 12 pages, Jun. 12–14, 1995.

S. Singh, A Survey of Automation in Excavation, Journal of the Mining and Materials Processing Institute of Japan, vol. 12, pp. 497–504, 1996.

S. Sarata, K. Sato, S. Yuta, Motion Control for Autonomous Wheel Loader Operation, Proceedings International Symposium on Mine Mechanization & Automation, 12 pages, Jun. 1995.

A. Kovio, Planning for Automatic Excavator Operations, 9th International Symposium on Automation & Robotics in Construction, pp. 869–878, Jun. 1992.

S. Singh & A. Kelly, Robot Planning in the Space of Feasible Actions: Two Examples, Proceedings International Conference on Robotics & Automation, 8 pages, Apr. 1996.

*Primary Examiner*—Christopher J. Novosad
*Attorney, Agent, or Firm*—Blackwell Sanders Peper Martin

[57] ABSTRACT

In one embodiment of the present invention, a planning system and method for earthmoving operations such as digging a foundation or leveling a mound of soil is disclosed including three different levels of processing for planning the excavation. One of the processing levels is a coarse-level planner that uses geometry of the site and the goal configuration of the terrain to divide the excavation area into a grid-like pattern of smaller excavation regions and to determine the boundaries and sequence of excavation for each region. The next level is a refined planner wherein each excavation region is, in order of the excavation sequence provided by the coarse planner, searched for the optimum excavation that can be executed. This is accomplished by choosing candidate excavations that meet geometric constraints of the machine and that are approximately within the boundaries of the region being excavated. The refined planner evaluates the candidate excavations using a simulated model of a closed loop controller and by optimizing a cost function based on performance criteria such as volume of material excavated, energy expended, and time, to determine the optimal location and orientation of a bucket of an excavator to begin excavating the region. The third level of the excavation planner is a control scheme wherein the selected excavation is executed by a closed loop controller that controls execution of a commanded excavation trajectory by monitoring forces exerted on a bucket, stick, and boom on an excavating machine.

27 Claims, 5 Drawing Sheets

METHOD AND APPARATUS FOR DETERMINING AN EXCAVATION STRATEGY

This appln claims benefit of provisional appln 60/068, 247 Dec. 19, 1997.

TECHNICAL FIELD

This invention relates generally to a system and method for planning a strategy for performing an excavating operation by an earthmoving machine, and more particularly, to a system and method for determining an optimum excavation strategy by evaluating a series of candidate excavations.

BACKGROUND ART

Machines such as excavators, backhoes, front shovels, and the like are used for earthmoving work. These earthmoving machines have work implements which consist of boom, stick, and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete earthmoving work cycle.

In a typical work cycle, the operator first positions the work implement at an excavation location, and lowers the work implement downward until the bucket penetrates the soil. Then the operator coordinates movement of several joints to bring the bucket toward the excavating machine. The operator subsequently curls the bucket to capture the soil. To unload the captured material, the operator raises the work implement, swings it transversely to a specified unloading location, and releases the soil by extending the stick and uncurling the bucket. The work implement is then returned to the excavation location to begin the work cycle again.

There is an increasing demand in the earthmoving industry to automate the work cycle of an excavating machine for several reasons. Unlike a human operator, an automated excavating machine remains consistently productive regardless of environmental conditions and prolonged work hours. The automated excavating machine is ideal for applications where conditions are unsuitable or undesirable for humans. An automated machine also enables more accurate excavation and compensates for lack of operator skill.

The major components for autonomous excavation, e.g., digging material, loading material into trucks, and recognizing loading receptacle positions and orientations, are currently under development. All of these functions are typically performed by software in computers. The planning steps required to determine a strategy for an optimal excavation is required. The specific location for each excavation, and the approach of the implement to the excavation start point must be determined so that the excavating process is performed as efficiently as possible.

Accordingly, the present invention is directed to overcoming one or more of the problems as set forth above.

DISCLOSURE OF THE INVENTION

In one embodiment of the present invention, a planning system and method for earthmoving operations such as digging a foundation or leveling a mound of soil is disclosed including three different levels of processing for planning the excavation. One of the processing levels is a coarse-level planner that uses geometry of the site and the goal configuration of the terrain to divide the excavation area into a grid-like pattern of smaller excavation regions and to determine the boundaries and sequence of excavation for each region. The next level is a refined planner wherein each excavation region is, in order of the excavation sequence provided by the coarse planner, searched for the optimum excavation trajectory that can be executed. This is accomplished by choosing candidate excavations that meet geometric constraints of the machine and that are approximately within the boundaries of the region being excavated. The refined planner evaluates the candidate excavations using a feed-forward model of the excavation process and by optimizing a cost function based on performance criteria such as volume of material excavated, energy expended, and time, to determine the optimal location and orientation of the bucket to begin excavating the region.

BEST MODE FOR CARRYING OUT THE INVENTION

Figure 1:
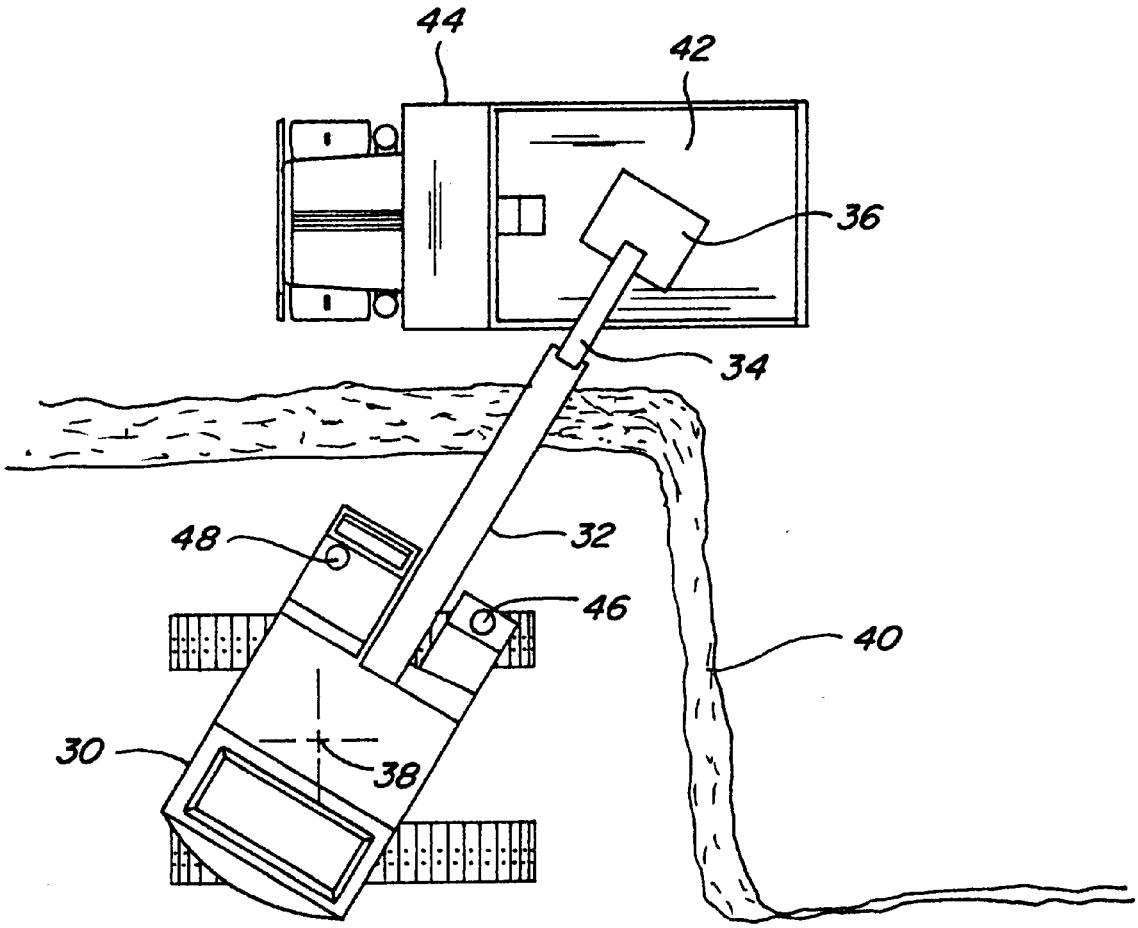
FIG. 1 is a top plan view of an excavation site.

Referring to the drawings, FIG. 1 is an overview of an example of an excavation site showing an excavator 30 having a work implement that includes a boom 32, a stick 34 and a bucket 36. The excavator 30 is also designed to rotate horizontally about an axis 38 for moving the work implement from the excavation area or dig face to an unloading point 42, shown in FIG. 1 as the bed of a dump truck 44.

The excavator 30 may be equipped with one or more sensor systems 46, 48 that are positioned to provide information regarding the excavation environment throughout the progress of the work cycle. The sensor systems 46, 48 are integrated with a control system (not shown) for independent, cooperative operation. When the control system operates the sensor systems 46, 48 independently, each sensor system 46, 48 provides information on different regions of the excavation environment. This allows the control system to process information for multiple tasks concurrently, and determine optimal movement and timing of operation for controlling the excavator 30. When the sensor systems 46, 48 are used cooperatively, they may provide information regarding the same area to allow a task to be performed more effectively. Whether operating independently or cooperatively, the sensor systems 46, 48 are positioned on the excavator 30 or at a location near the excavation site 40 that allows the sensors to scan the desired portions of the environment. The data acquired by the sensor systems 46, 48 is sent to a data server (not shown) and processed to create an elevation map of the surrounding terrain. This terrain map can be used by the present excavation planner as it surveys the surrounding area for the optimum excavation site.

Figure 2:
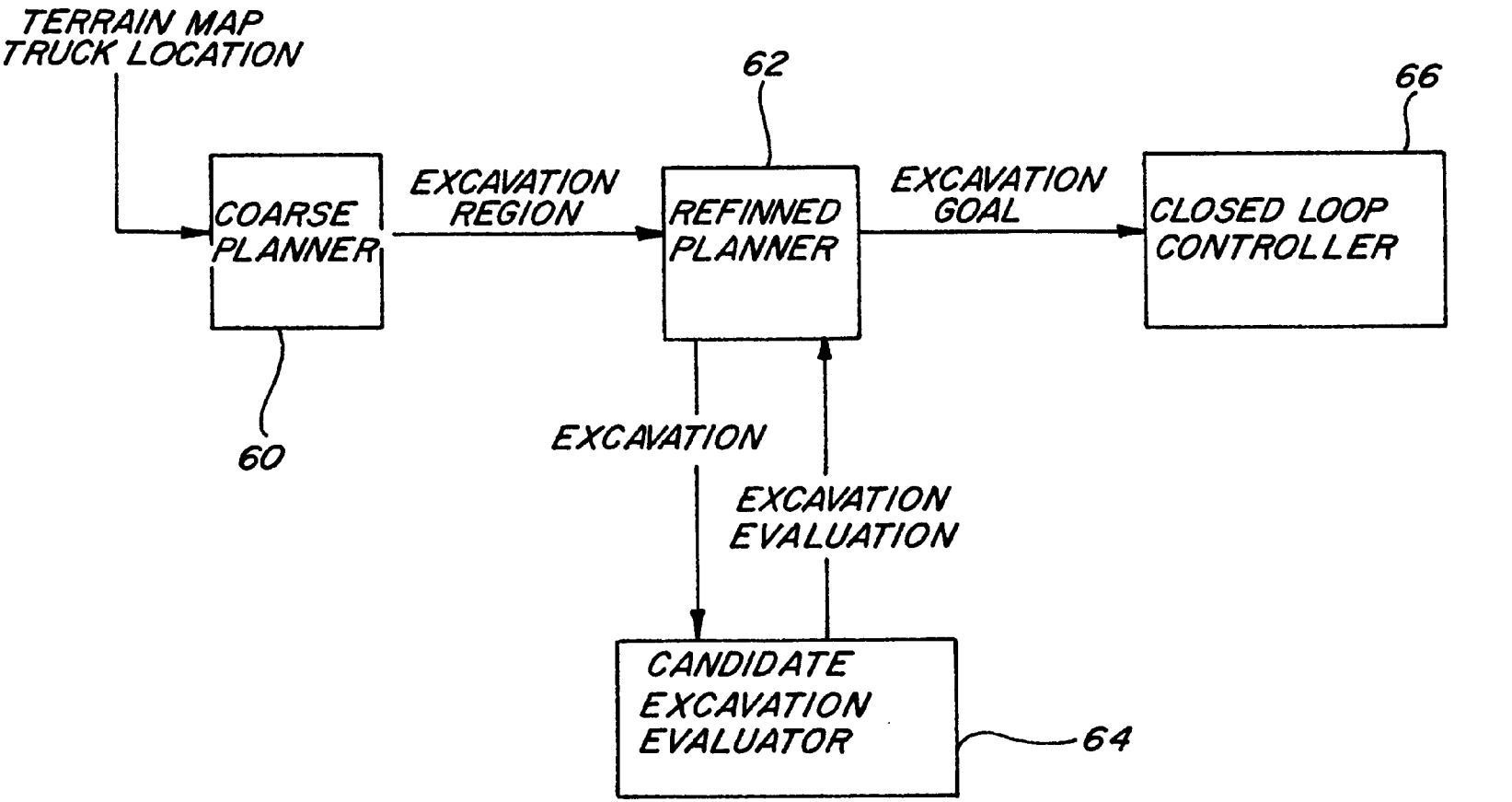
FIG. 2 is a block diagram of an embodiment of the present invention.

FIG. 2 shows a block diagram of the components of an embodiment of an excavation planner 58 according to the present invention. The components of the present excavation planner 58 include a coarse planner 60, a refined planner 62, a candidate excavation evaluator 64, and a closed loop controller 66. The coarse planner 60 receives information regarding the excavation environment from a data server (not shown). Other software modules provide information regarding the receptacle or other location in which to unload the excavated material. The coarse planner 60 divides, or tessellates, the excavation area into smaller regions and selects a particular region based on the overall strategy for removing material. This information is provided to the refined planner 62 which searches within the region's limits for a locally optimal set of excavation parameters that define the position and orientation of the excavator's bucket as it enters the earth. The closed loop controller 66 governs control of the excavating process from the time that the bucket enters the face of the excavation site until the excavation stroke is completed.

Figure 3:
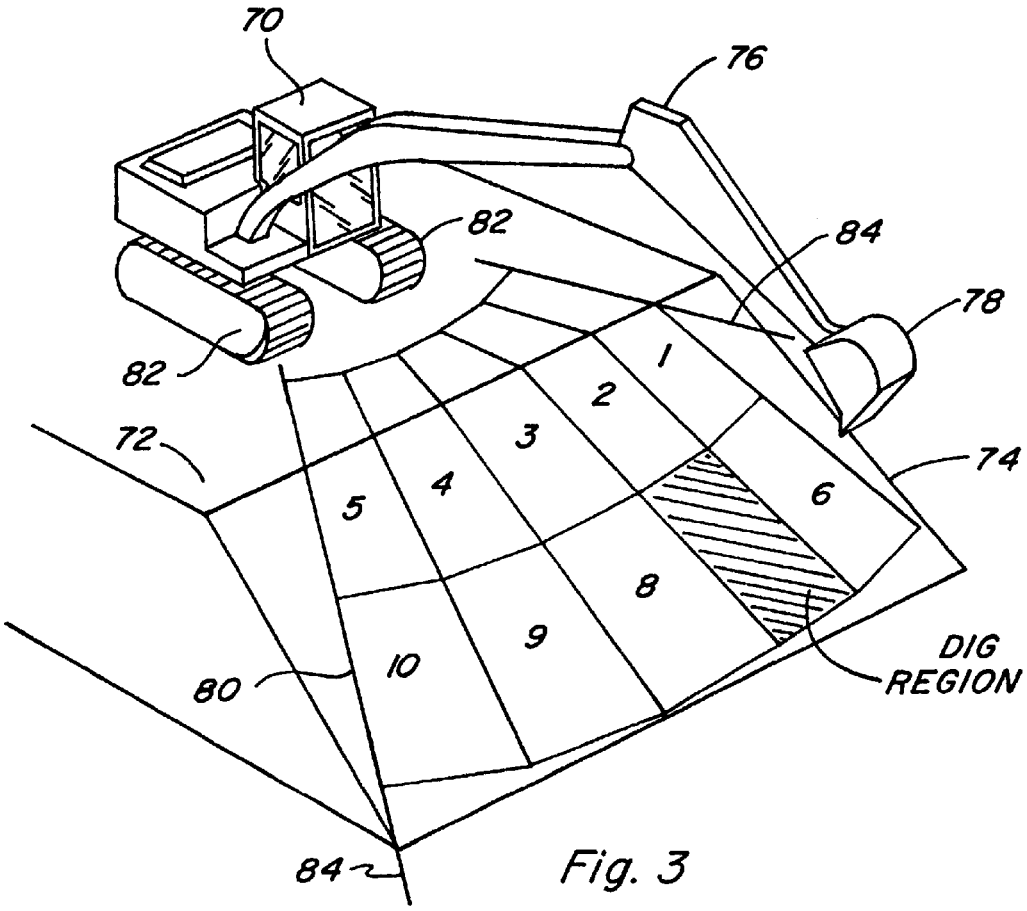
FIG. 3 is a perspective view of an excavation site divided into regions by the coarse planner.

The coarse planner 60 involves using an overall generalized strategy for removing material from an excavation site in an organized and efficient manner based on an approach typically followed by expert operators. FIG. 3 shows a machine, namely, an excavator 70, in a "bench loading" application where the excavator 70 is positioned on a raised portion of the terrain above an excavation site 72 so that a work implement 76 may be lowered to excavate into a face 74 of the site 72, which is also known as a "bench". Once a bucket 78 is filled, the work implement 76 is raised and the excavated material is unloaded into a nearby receptacle, such as a dump truck (not shown).

The coarse planner divides, or tessellates, the excavation site 72 into a grid 80 of smaller regions. The coarse planner then selects a particular region based on methodologies used by expert operators, such as removing the material from left to right, when the cab of the excavator is on the left, and from the top of the excavation site 72, and then repeating this sequence at the bottom of the face 74. When the cab of the excavator is on the right, the material may be removed from right to left so that the operator has an unobstructed view while moving the excavator. The numbers 1 through 10 shown on each region of the grid 80 in FIG. 3 indicate the sequence in which the regions are excavated according to this methodology. This methodology has several advantages. In this example, the loading receptacle (not shown) is positioned to the left side of the excavator 70. After excavating, the excavator 70 swings to the left to unload the material in the receptacle. By removing material from the leftmost position first, the work implement 76 does not need to be raised as high to clear material when swinging to the receptacle, thus improving overall cycle time. Further, by excavating from top to bottom, lower forces are required from the work implement 76 when digging in the lower regions because the weight of the material in the upper regions is eliminated and therefore does not contribute to the soil reaction forces. Additionally, clearing material away from the upper regions can result in an unobstructed view of the material below. Notably, these advantages apply whether the excavator 70 is operated by a human or autonomously.

Once the strategy for removing material is determined, the coarse planner involves further logic for determining boundary information to be used by the refined planner. In the preferred embodiment as shown in FIG. 2, one of the inputs to the coarse planner 60 is a terrain map that is a numerical description of the shape of the terrain. The coarse planner 60 executes an edge detection algorithm using the terrain map to find the boundaries of the excavation regions. In FIG. 3, the workspace around the excavator 70 at a given position is defined by a semi-cylindrical shape and the regions in the excavation grid 80 are therefore defined using a cylindrical coordinate system. Outer radial extents 84 of the excavation site 72 may be defined by either the boundaries of the material to be excavated or the kinematic limits of the machine. Using the kinematic limits of the machine, the outer radial extents 84 of the grid 80 are defined such that the excavator 70 remains in a stable position during the excavation. For instance, a set of tracks 82 on the excavator 70 provide a more stable platform for excavation when the work implement 76 is within the radial extents of the excavator's tracks 82.

Figure 4:
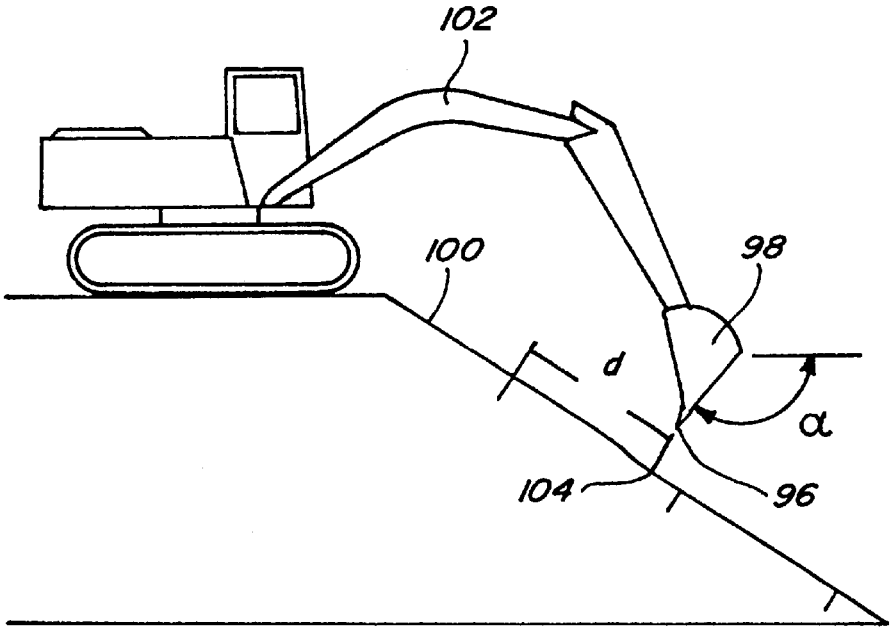
FIG. 4 is a side view of an excavator at the excavation site showing the parameters for defining the optimum position and orientation of the bucket as it enters the dig face.

Within the outer radial extents 84, the excavation site 72 is divided into excavation regions having approximately rectangular boundaries that are approximately one bucket width wide, with overlap at the top of the face 74. Using the boundaries of the selected excavation region that were determined by the coarse planner, the refined planner then searches for a location to start the excavation. In FIG. 4, a starting position 94 is shown at one end of a distance d, where d is defined by the radial distance from the top of region A to the point where the leading edge 96 of the bucket will strike the face of the bench 100, and $\alpha$ is an orientation angle of the leading edge 96 of the excavator's bucket 98 as it approaches the bench 100. Since control of the excavation is governed by the closed-loop controller that takes over from the time that the leading edge 96 of the bucket 98 enters the bench 100, the refined planner only searches for the position d and orientation $\alpha$ of the bucket as it enters the bench 100.

Figure 5:
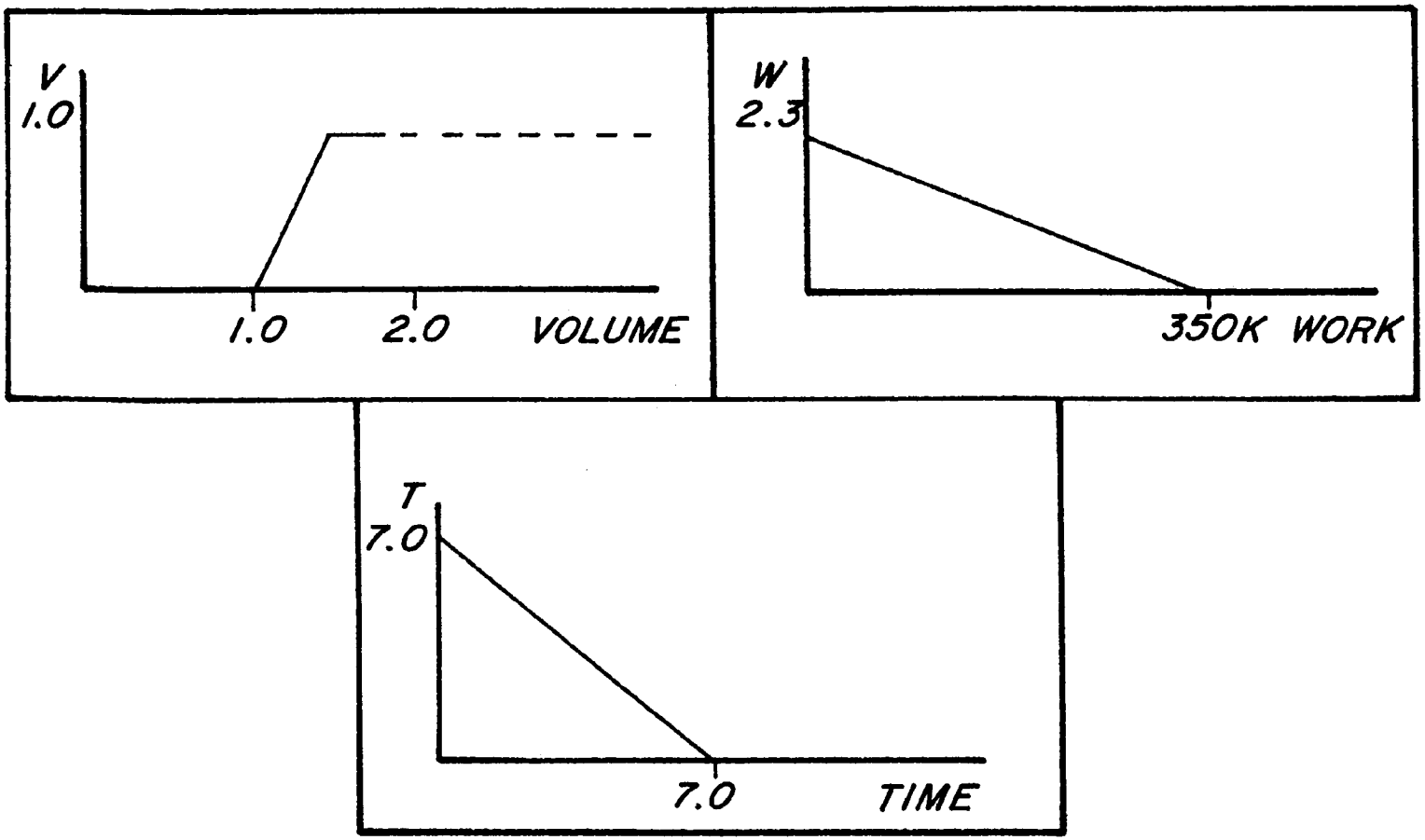
FIG. 5 shows examples of evaluation criteria for selecting the excavation region.

The optimum starting position 94 and orientation $\alpha$ can be found by evaluating the trajectories achieved using candidate parameters for d and $\alpha$. In the preferred embodiment, the candidate parameters are evaluated in two ways. First, a candidate set of parameters is checked for feasibility, such as whether the machine configuration required by the proposed excavation parameters are acheivable. Second, the quality of a candidate action is computed to select the action that achieves the best results. Both evaluation processes require a prediction of the outcome of a selected action. One way this prediction may be made is by using a forward simulation model of the closed loop controller that determines the trajectory of the work implement 102. The model of the closed loop controller predicts the trajectory of the bucket during each excavation stroke using the starting position 94 and orientation $\alpha$ of the bucket. The condition of the material (for example, wet sand or loose soil) may also be considered to predict the resistive forces that the bucket will encounter while excavating. In addition to generating the trajectory of the bucket, the simulation model computes the time and energy required to perform the excavation, and the amount of material that is swept into the bucket. FIG. 5 shows a graphical depiction of example of criteria for selecting candidate parameters d and $\alpha$. To compare one set of candidate parameters with others, a quality value, Q, defined by a function, such as the following, may be used:

$$Q=V(\text{volume})*W(\text{energy})*T(\text{time}).$$

This example function quantifies the overall quality of the simulated trajectory. The example functions V, T, and W are dependent on volume swept, energy, and time required for digging, respectively. To illustrate the behavior of these functions, consider, for example, how the V function is defined in FIG. 5. When the bucket sweeps less that 1 cubic meter, the V value is zero, and hence the quality value is zero. This means that all candidate excavations that sweep less than 1 cubic meter are discarded. As the swept volume increases over 1 cubic meter, the V function increases linearly, and the quality value improves accordingly. Above 1.5 cubic meters, however, the V function does not increase. This is because the bucket's capacity is 1.5 cubic meters and no additional value is attached to sweeping beyond this amount of material. Similarly, the T and W functions decrease linearly as the time and energy required to dig increases. The magnitude of Q is thus a measure of how well the excavation matches these performance criteria. The candidate parameters that correspond to the quality of the results that is desired, which will typically be the highest quality, are then chosen. Functions that are dependent on other variables that pertain to the quality of the desired results may also be used instead of, or in addition to, the example function given hereinabove.

Once the trajectory of the bucket is predicted, it can be analyzed for additional constraint violations. For instance, it may not be desirable to dig below a given floor height, or to leave divots and potholes that may present problems for other machines. The trajectory is therefore also evaluated with regard to a shape constraint, which keeps the results of the excavation within some predetermined shape. This shape may correspond to any desired shape that the excavator is capable of achieving, such as an excavated area for a foundation having straight or sloping sides, and a flat or angled floor.

Figure 6:
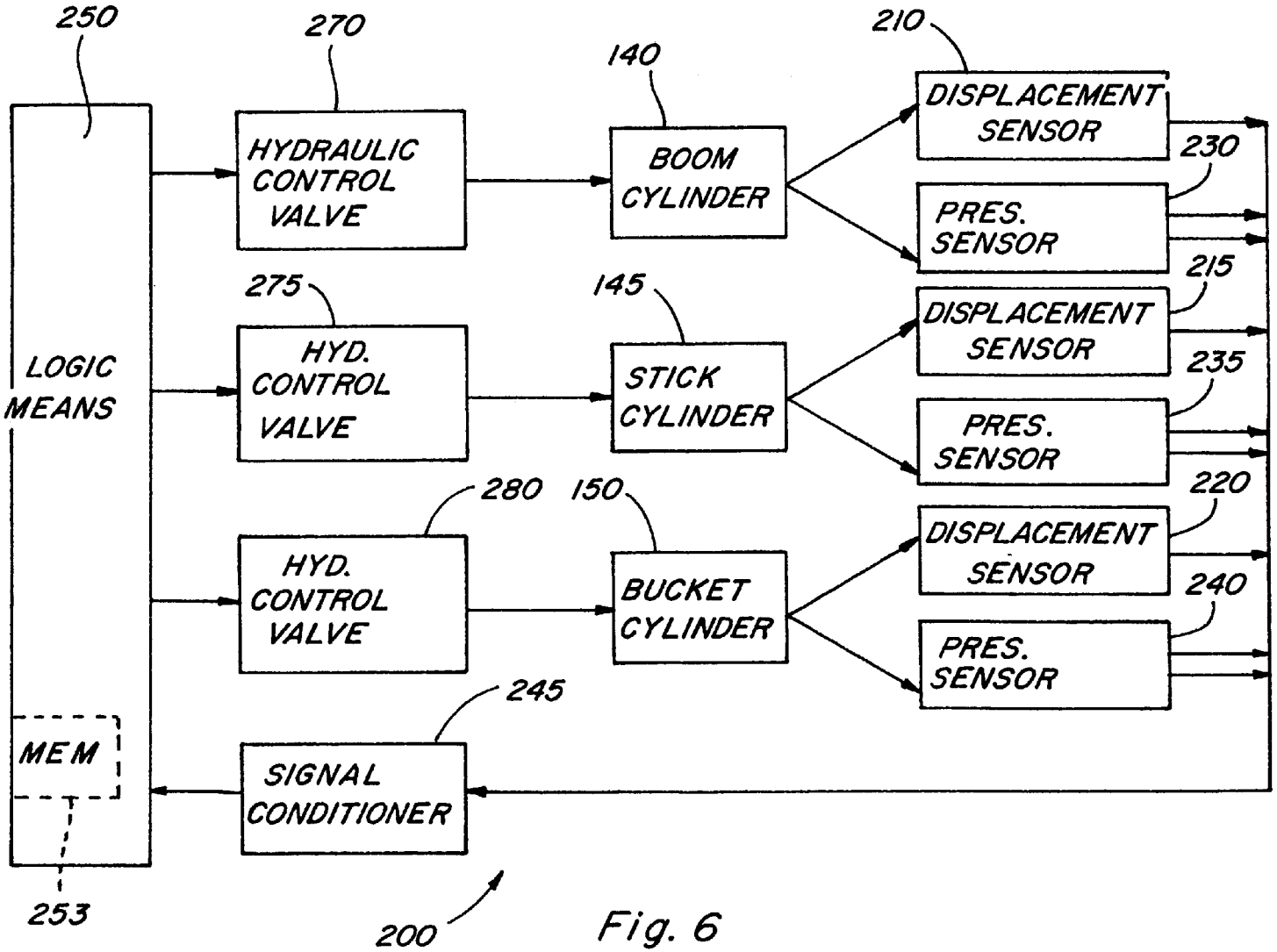
FIG. 6 is a block diagram of an embodiment of a closed loop controller.

The closed loop controller for the work implement generates commands for controlling actuation of hydraulic cylinders which are operably connected to the bucket, stick and boom. FIG. 6 shows a block diagram of an embodiment of a closed loop controller 200 that may be incorporated with the present invention. The closed loop controller 200 includes position sensors 210, 215, 220 that produce respective position signals in response to the respective positions of a boom cylinder 140, stick cylinder 145 and bucket cylinder 150. Pressure sensors 230, 235, 240 produce respective pressure signals in response to the associated hydraulic pressures associated with the boom, stick, and bucket hydraulic cylinders 140, 145, 150. A microprocessor 250 receives the position and pressure signals through a signal conditioner 245, and produces command signals that controllably actuate predetermined control valves 270, 275, 280 which are operably connected to the hydraulic cylinders 140, 145, 150 to perform the work cycle. The microprocessor 250 uses the pressure signals and cylinder positions to guide the bucket during the excavation and to determine when digging is complete.

INDUSTRIAL APPLICABILITY

The algorithm for determining the excavation strategy is formulated as a constrained optimization problem requiring a description of the terrain in the form of a terrain map, kinematic and dynamic models of the excavator, and models of resistive force experienced during excavation. The refined planning algorithm computes a sequence of bucket motions (as specified by the starting and ending position and orientation of the bucket) for several different candidate motion sequences including one or more excavations, floor cleanup, and the distance that an excavator located on a bench can track backward. The motion sequences for candidate excavations are evaluated based on volume excavated, depth excavated, time required, and energy expended, to determine the optimal location from which to start the excavation.

The floor cleanup algorithm first determines the number of sweeping actions that must be performed. The trajectories are chosen such that the rectangles traced out by the bucket along the floor just overlap at the far reach of the excavator and end at the place where the floor meets the face of the bench. This helps remove any residual material that was left during excavation of the neighboring region. Next, the algorithm minimizes the floor cleanup actions based on the sections of the floor that are above a preset threshold of height above a desired height. The computation of "backup" distance is done by taking the difference between the distance that an excavator can reach and the distance that it has to reach based on the material that remains on the bench and the floor.

Logic to determine the optimal action to take may include determining whether a receptacle, such as a dump truck, is waiting to be loaded. If there is no receptacle available to be loaded, the present invention may evaluate whether backing up and repositioning the excavator will provide more optimal results. Such logic helps maximize the productivity of the excavator as the excavator continues excavating until the loading receptacle is full (or the material to be excavated runs out). Thus, the present invention uses time that the excavator would otherwise be idle (waiting for the next loading receptacle) to reposition itself.

The present invention also provides a means to efficiently excavate a variety of terrain geometries. The strategy may be used on-line during the operation of an excavator to plan the sequence as the excavation progresses.

Other aspects, objects and advantages of the present invention can be obtained from a study of the drawings, the disclosure and the appended claims.

What is claimed is:

1. A method for planning earthmoving operations using a terrain map of an excavation area, and an excavator having a work implement comprised of a bucket, stick, and boom linked together in sequence and movably actuated by hydraulic cylinders, the method comprising the steps of:

(a) dividing the excavation area into a plurality of excavation regions using expert heuristics;

(b) determining at least one candidate location of the bucket for starting an excavation for each excavation region;

(c) predicting an excavation result of each candidate location;

(d) determining a level of quality of the predicted excavation results by evaluating at least one performance parameter; and (e) selecting a starting location as a function of the level of quality of the predicted excavation results.

2. The method as set forth in claim 1 wherein step (a) further comprises dividing the excavation area into a plurality of excavation regions within a cylindrical coordinate frame, and determining radial extents of the excavation regions based on kinematic constraints of the excavator.

3. The method as set forth in claim 1 wherein step (a) further comprises assigning a sequence number to each excavation region corresponding to the order in which the region is to be excavated.

4. The method as set forth in claim 1 wherein step (b) further comprises determining a candidate location of the bucket to clean up the floor of the excavation region.

5. The method as set forth in claim 4 wherein step (c) further comprises using a feed-forward model of the excavation process to predict the excavation result.

6. The method as set forth in claim 1 wherein step (b) further comprises determining a new position for the excavator before selecting a candidate location of the bucket.

7. The method as set forth in claim 6 wherein step (d) further comprises determining the level of quality of the predicted excavation results by evaluating the amount of time required to complete the predicted trajectory.

8. The method as set forth in claim 1 wherein step (b) further comprises determining an orientation of the leading edge of the bucket.

9. The method as set forth in claim 8 wherein step (c) further comprises using a simulated model of a closed loop controller to predict the trajectory of the work implement during excavation based on the starting location and orientation of the bucket and characteristics of the material being excavated.

10. The method as set forth in claim 1 wherein step (d) further comprises determining the level of quality of the predicted excavation results by evaluating the energy expended in completing the excavation.

11. The method as set forth in claim 1 wherein step (d) further comprises determining the level of quality of the predicted excavation results by evaluating the volume of material captured in the bucket during the excavation.

12. The method, as set forth in claim 1, wherein step (d) further comprises determining the number of sweeping actions required to clean up the floor of the excavation area and computing the distance required to reposition the excavator to reach material on the floor and on the bench of the excavation area.

13. A method for planning earthmoving operations using a terrain map of an excavation area, and an excavator having a work implement comprised of a bucket, stick, and boom linked together in sequence and movably actuated by hydraulic cylinders, the method comprising the steps of:

(a) dividing the excavation area into a plurality of excavation regions;

(b) determining at least one candidate location of the bucket for starting an excavation for each excavation region;

(c) predicting an excavation result of each candidate location;

(d) determining a level of quality of the predicted excavation results by evaluating at least one performance parameter including the energy expended in performing the excavation; and (e) selecting a starting location as a function of the level of quality of the predicted excavation results.

14. A method for planning earthmoving operations using a terrain map of an excavation area, and an excavator having a work implement comprised of a bucket, stick, and boom linked together in sequence and movably actuated by hydraulic cylinders, the method comprising the steps of:

(a) dividing the excavation area into a plurality of excavation regions;

(b) determining at least one candidate location of the bucket for starting an excavation for each excavation region;

(c) predicting an excavation result of each candidate location using a simulated model of a closed loop controller to predict the trajectory of the work implement during excavation based on the starting location and orientation of the bucket and characteristics of the material being excavated;

(d) determining a level of quality of the predicted excavation results by evaluating at least one performance parameter; and (e) selecting a starting location as a function of the level of quality of the predicted excavation results.

15. An apparatus for planning earthmoving operations using a work implement of an excavating machine, the work implement including a boom, stick, and bucket, the boom, stick, and bucket being controllably actuated by at least one respective hydraulic cylinder, the planning apparatus comprising:

a terrain map of an excavation site represented in numerical form; and a data processor operable to access information in the terrain map, divide the excavation area into a plurality of excavation regions using expert heuristics, determine at least one candidate location for starting an excavation for each excavation region, predict the excavation results of each candidate location, determine the quality of the predicted excavation results by evaluating at least one performance parameter, and select a starting location as a function of the quality of the predicted excavation results.

16. The apparatus as set forth in claim 15 wherein the data processor is further operable to divide the excavation area into a plurality of excavation regions within a cylindrical coordinate frame, and to determine radial extents of the excavation regions based on kinematic constraints of the excavating machine.

17. The apparatus as set forth in claim 15 wherein the data processor is further operable to assign a sequence number to each excavation region corresponding to the order in which each region is to be excavated.

18. The apparatus as set forth in claim 15 wherein the data processor is further operable to determine a candidate starting location of the bucket to clean up the floor of the excavation region.

19. The apparatus as set forth in claim 15 wherein the data processor is further operable to determine a new position for the excavator before selecting a candidate starting location of the bucket.

20. The apparatus as set forth in claim 15 wherein the data processor is further operable to determine the orientation of the leading edge of the bucket.

21. The apparatus as set forth in claim 20 wherein the data processor is further operable to predict the trajectory of the work implement during the excavation based on the starting location and orientation of the bucket and characteristics of the material being excavated using a simulated model of a closed loop controller.

22. The apparatus as set forth in claim 15 wherein the data processor is further operable to determine the level of quality of the predicted excavation results by evaluating the energy expended in completing the excavation.

23. The apparatus as set forth in claim 15 wherein the data processor is further operable to determine the level of quality of the predicted excavation results by evaluating the volume of material captured in the bucket during the excavation.

24. The apparatus as set forth in claim 15 wherein the data processor is further operable to determine the level of quality of the predicted excavation results by evaluating the amount of time required to complete the predicted trajectory.

25. The apparatus as set forth in claim 15, wherein the data processor is further operable to determine the number of sweeping actions required to clean up the floor of the excavation area and to compute the distance required to reposition the excavator to reach material on the floor and on the bench of the excavation area.

26. An apparatus for planning earthmoving operations using a work implement of an excavating machine, the work implement including a boom, stick, and bucket, the boom, stick, and bucket being controllably actuated by at least one respective hydraulic cylinder, the planning apparatus comprising:

a terrain map of an excavation site represented in numerical form; and a data processor operable to access information in the terrain map, divide the excavation area into a plurality of excavation regions, determine at least one candidate location for starting an excavation for each excavation region, predict the excavation results of each candidate location based on the starting location and orientation of the bucket and characteristics of the material being excavated using a simulated model of a closed loop controller, determine the quality of the predicted excavation results by evaluating at least one performance parameter, and select a starting location as a function of the quality of the predicted excavation results.

27. An apparatus for planning earthmoving operations using a work implement of an excavating machine, the work implement including a boom, stick, and bucket, the boom, stick, and bucket being controllably actuated by at least one respective hydraulic cylinder, the planning apparatus comprising:

a terrain map of an excavation site represented in numerical form; and a data processor operable to access information in the terrain map, divide the excavation area into a plurality of excavation regions, determine at least one candidate location for starting an excavation for each excavation region, predict the excavation results of each candidate location based on the starting location and orientation of the bucket, determine the quality of the predicted excavation results by evaluating at least one performance parameter including the energy expended in performing the excavation, and select a starting location as a function of the quality of the predicted excavation results.

* * * * *